United States Patent [19]

Rankin

[11] Patent Number: 5,011,138

[45] Date of Patent: Apr. 30, 1991

[54] SPORTS DEVICE

[76] Inventor: J. Cameron Rankin, 212 Burgwyn Rd., Montgomery, Ala. 36105

[21] Appl. No.: 468,224

[22] Filed: Jan. 19, 1990

[51] Int. Cl.[5] ..... A63B 21/06; A63B 67/22

[52] U.S. Cl. ..... 272/117; 272/124; 272/93; 272/100; 273/109; 273/110

[58] Field of Search ..... 128/67, 68, 93, 116, 128/117, 118, 120, 126, 127, 131, 135; 272/1 R, 1 G, 1 GA, 1 GE, 1 GF, 1 GI, 58 K, 58 R, 85 R, 85 C, 85 D, 108, 109, 110, 119 R, 333, 346, DIG. 26, 124, 323

[56] References Cited

U.S. PATENT DOCUMENTS

| | | | |
|---|---|---|---|
| 2,871,017 | 1/1959 | Cook | 272/124 |
| 3,118,676 | 1/1964 | Louis | 273/109 |
| 3,134,595 | 5/1964 | Chenoweth et al. | 273/109 |
| 3,475,024 | 10/1969 | Lewis | 272/117 |
| 3,637,205 | 1/1972 | Bankston | 272/93 |
| 3,874,660 | 4/1975 | Brethen | 272/124 |
| 3,946,518 | 3/1976 | Ylitalo | 273/109 |
| 4,557,701 | 12/1985 | Giallombardo | 273/110 |

FOREIGN PATENT DOCUMENTS

| | | | |
|---|---|---|---|
| 257959 | 9/1926 | United Kingdom | 272/124 |

*Primary Examiner*—Richard J. Apley
*Assistant Examiner*—Lynne A. Reichard
*Attorney, Agent, or Firm*—John C. Garvin, Jr.

[57] ABSTRACT

A sports device comprising an elongated support having a handle thereon for gripped engagement by an individual to impart a tilting motion to the elongated support. A removable weight shifting means is mounted at one end of the elongated support for changing the balance point of the elongated support responsive to the tilting motion. A concave track is supported on the elongated support and is provided at its opposite ends with a ramp disposed in inclined relation relative to the track. A ball is provided for placement in the track and is disposed for controlled rolling movement therealong responsive to the tilting motion. A ball ejecting member is mounted at the end of each ramp and each such member includes an angled surface for impact by the ball and ejection thereof from the elongated support responsive to the ball exceeding a predetermined speed as a result of excessive tilting motion of the track. Indicating means are provided for signaling when the elongated support has "safely" been tilted to a predetermined limit (for one round trip of the ball without the ball being ejected) resulting in a score. The indicating means also signals when the predetermined tilt limit has been exceeded resulting in a "foul". In an alternative arrangement, the ball is controlled to drop through a hole in an inclined track for "bombarding" a target located below the hole for a "score". A "foul" is indicated when the tilting motion exceeds a predetermined limit as discussed above.

61 Claims, 4 Drawing Sheets

SPORTS DEVICE

BACKGROUND OF THE INVENTION

This invention relates generally to manual weightlifting devices of the unconstrained free-handling type disposed to be manually lifted from its resting place, and specifically to a complete transformation thereof so revolutionary that it limits the amount of weight capable of being lifted to almost zero as compared to the conventional hundreds of pounds, and in the process completely eliminates the familiar tortured scenario of jerky-body contortion, bulging eyes, and puffed cheeks by demanding no movement of the body during the manipulation of the device.

Five alternative embodiments of the present sports device are presented which share common features. The first two embodiments are designated as ball-on-a-pole embodiments and the second two embodiments are designated as ball-over-a-pole embodiments. The fifth embodiment is directed to an alternative indicating system for use with the first four embodiments.

Each of the two ball-on-a-pole embodiments presents a tantalizing challenge to see who can grasp the most unbalanced pole with one hand, and tilt it to let a ball roll along a slippery track on a round trip from one end of the pole to the other and back without losing either the ball or the two lower of four rings carried on a support positioned at the inner end of the pole while dislodging the two upper rings during which each rotation of ball and each fractional movement of each sliding weight disc carried on another support positioned at the outer end of the pole produces a shifting of the balance point of the pole, thereby undergoing ever-greater rotational and sliding changes in downward pressure and effective weight plus an inward and outward slamming—a rousing gamesmanship so unique and challenging that it razzle-dazzles the weightlifting record down to almost zero by demanding the coordination of both delicate dexterity and brute strength every moment along the way from gentle liftoff to gentle touchdown, and with a full-length pole would seem most likely to stop an overwhelming majority of any large group of young men picked at random before the actual weight of the pole, including the ball, reaches a mere two and one-half (2 ½) pounds in view of the many booby traps lurking. For example, in each round of action with the in-line/ball-on embodiment, each player must deal with the following 12 threats to loss of control listed in the order of initial exposure: (1) reduced downward pressure with each rotation of incoming ball; (2) drifting of incoming ball: (3) rebounding of incoming ball; (4) reduced downward pressure the farther incoming weight discs 10 slide; (5) slamming of incoming weight discs; (6) continued incoming motion of lower outer ring; (7) increased downward pressure with each rotation of outgoing ball: (8) drifting of outgoing ball: (9) rebounding of outgoing ball: (10) increased downward pressure the farther outgoing weight discs slide; (11) slamming of outgoing weight discs; and (12) continued outgoing motion of lower inner ring. Operating solely on the law of gravity, the one-handed manipulation of each of these two ball-on-a-pole embodiments with mandatory delicate dexterity by its very nature demands such an unusually smooth and restrained body motion from start to finish that it produces no noticeable increase in rate of breathing.

In each of the two ball-over-a-pole embodiments, a participant grasps the unbalanced pole with one hand, and tilts it to let a ball roll through a small opening and "up" an inclined slippery track and then through another small opening at its summit to dive-bomb the pole below without losing either the ball or the two lower of four rings while dislodging the two upper rings during which each rotation of ball and each fractional movement of each sliding weight disc produces a shifting of the balance point of the pole, thereby likewise undergoing ever-greater rotational and sliding changes in downward pressure and effective weight plus an inward and outward slamming—a rousing gamesmanship likewise so unique and challenging that it also razzle-dazzles the weightlifting record down to almost zero by demanding the coordination of both delicate dexterity and brute strength every moment along the way from gentle liftoff to gentle touchdown which at crucial moments demands an even greater degree of delicate dexterity for pinpoint accuracy, and thus with a full-length pole would seem most likely to stop an overwhelming majority of any large group of young men picked at random with a lighter load than the two ball-on-a-pole embodiments, probably before the actual weight of the pole, including the ball, reaches a mere two and one-fourth (2¼) pounds. For example, in each round of action with the in-line/ball-over embodiment, each player must deal with the following 12 threats to loss of control listed in the order of initial exposure: (1) reduced downward pressure the farther incoming weight discs slide; (2) slamming of incoming weight discs; (3) continued incoming motion of lower outer ring; (4) bull's-eye #1; (5) increased downward pressure with each rotation of outgoing ball; (6) drifting of outgoing ball; (7) increased downward pressure the farther outgoing weight discs slide; (8) slamming of outgoing weight discs; (9) bull's-eye #2; (10) rebounding of overshot ball; (11) dive-bombing of pole; and (12) continued outgoing motion of lower inner ring. Likewise operating solely on the law of gravity, the one-handed manipulation of each of these two ball-over-a-pole embodiments with mandatory delicate dexterity demands an even smoother and more restrained body motion than the other two embodiments when pinpointing the ball through the two small openings—thereby again producing no noticeable increase in rate of breathing.

The fifth embodiment relates to an alternative indicating system which may be used in lieu of the four rings and the support structure therefor. In this embodiment, instead of dislodging a pair of upper rings from the support structure, an electrically-operated indicating system signals when the amount of tilt, which would have been necessary to dislodge the upper rings, has been reached. The system also indicates when excessive tilt, which would have caused the loss of the two lower rings, has been applied to the pole.

OBJECTS OF THE INVENTION

It is an object of the present invention to provide a sports device manually operable by an individual which requires extreme dexterity along with varying degrees of brute strength by the individual in order to successfully meet the challenge of the device.

It is another object of the present invention to provide such a sports device which is manipulated manually by an individual to impart a controlled tilting motion to the device for moving four different types of components therealong in a predetermined limited path in response to gravity.

It is still a further object of the present invention to provide such a sports device with an indicator which signals when the controlled tilting motion reaches a desired predetermined tilt and which also signals when the tilting motion has exceeded the desired predetermined tilt.

Another object of the present invention is to provide such a sports device which can be manufactured in various sizes for men, women, or children for their personal use and maximum enjoyment.

An even further object of the present invention is to provide such a sports device incorporating simplicity of design with economical and quality construction conducive to a long service life with normal use and care.

It is the primary object of the present invention to provide such a sports device which issues a tantalizing challenge to physical fitness enthusiasts of all ages and levels to "strut their stuff" in competition with their contemporaries in their own entry division with the regular staging of an organized sport competition which razzle-dazzles the weightlifting record down to almost zero by demanding the coordination of both delicate dexterity and brute strength every moment along the way from gentle liftoff to gentle touchdown while offering a player of superior dexterity/inferior strength at least six possible ways to outlift players of superior strength/inferior dexterity as follows:

(1) Their overzealous tilting movement of the sports device causing premature loss of a rolling component therefrom; (2) their exceeding a predetermined tilt limit of the sports device in a first direction causing premature loss of a sliding component therefrom; (3) their exceeding a predetermined tilt limit of the sports device in a second direction causing premature loss of another sliding component therefrom; (4) their added physical drain from a slower time per round; (5) their added physical drain from a greater number of rounds compounded by having to face the aforesaid 12 threats to loss of control one or more additional times while having to cope with the dead weight of the one or more extra disc tabs carried on the sports device; and (6) their greater number of weight discs wasted in the aborted last round that could have been successfully handled if included in the previous round.

BRIEF DESCRIPTION OF THE DRAWINGS

These and other objects and advantages of the present invention will become apparent from the following detailed description and the accompanying drawings, in which.

DETAILED DESCRIPTION OF EMBODIMENT "A"

Figures 1, 2, 3:
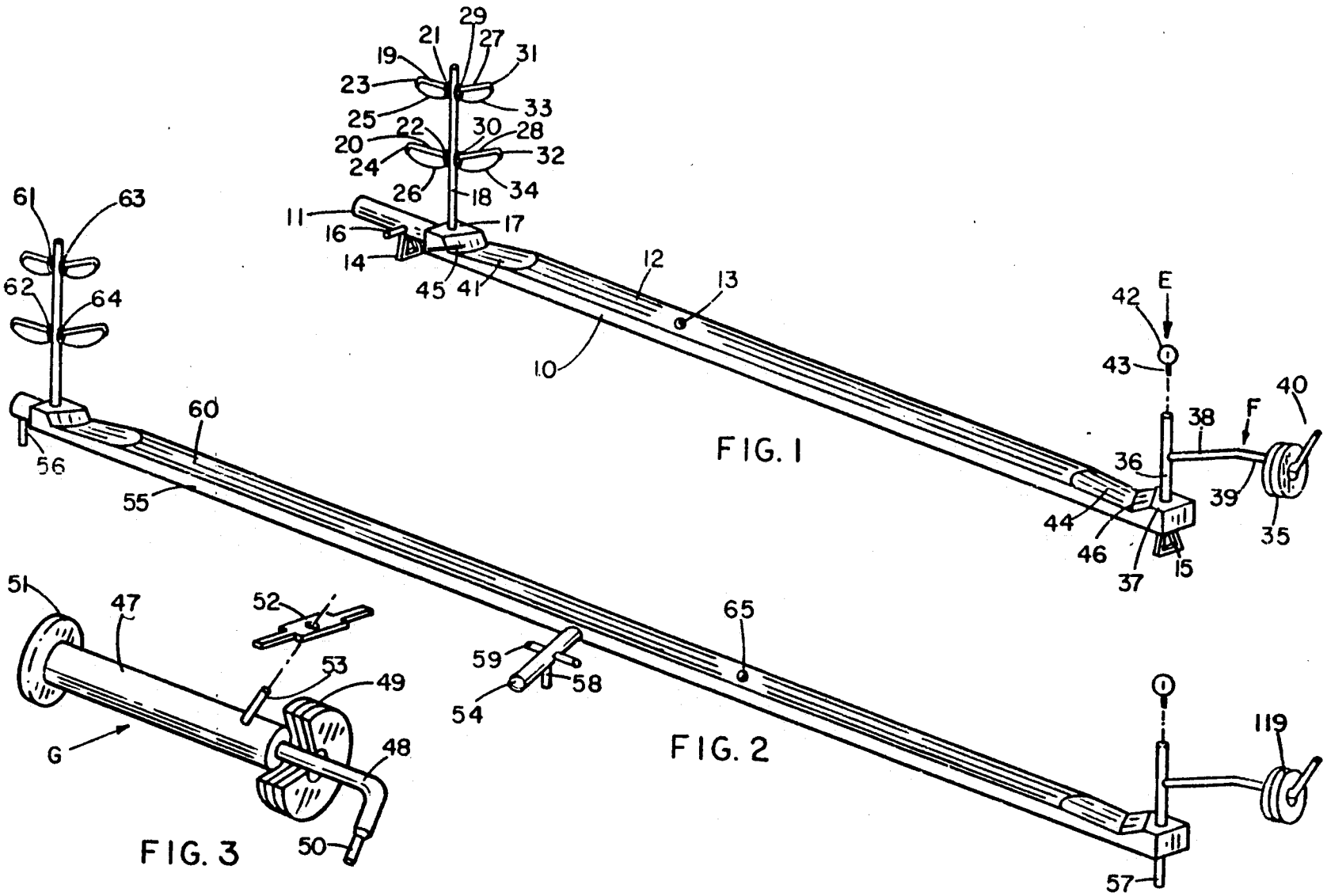
FIG. 1 is a perspective view of the in-line/ball-on embodiment "A" of the present sports device.
FIG. 2 is a perspective view of the off-line/ball-on embodiment "B" of the present sports device.
FIG. 3 is a perspective view of the disc dispenser for transferring the cumulative weight discs to and from the invented sports devices for maximum ease in handling and scorekeeping.

The in-line/ball-on sports device shown in FIG. 1 comprises an elongated member in the form of pole 10 with a handle 11 at one end thereof in alignment therewith, and supporting a longitudinal concave track 12 extending along the top thereof in which to let ball 13 roll from one end of pole 10 to the other and back in response to gravity, and even though pole 10 can be of various lengths, the longer the pole, the greater the challenge, which for the men's model would be about 5½ feet. Furthermore, for embodiment "A" (and all of the other embodiments), the longer the pole and the lighter it and its fixed attachments are, the closer to zero would be the record for the most actual weight lifted.

Ground support members comprising an inner stabilizer 14 and an outer stabilizer 15 at opposite ends of pole 10 are triangularly shaped for crosswise attachment to the underside of pole 10 as shown in FIG. 1; and with inner stabilizer 14 positioned to separate handle 11 from remainder of pole 10, and with outer stabilizer 15 preferably made of a resilient substance capable of withstanding physical abuse by flexing outward if pole 10 is allowed to swing downward and strike the floor at an angle. Each side of stabilizers 14 and 15 has a diameter of about ⅛ inch and is of whatever minimum width at its base would demand for maximum challenge that a player, after returning pole 10 to the floor, must release handle 11 with extreme caution while making certain that pole 10 is resting in an upright balanced position and won't topple laterally. Stabilizers 14 and 15 provide pole 10 with whatever minimum amount of parallel-to-floor clearance of about 1½ inches would allow a man with unusually thick knuckles just enough room to position his hand on handle 11 with the grip of his choice without otherwise having to tilt it—the objective being to require a maximum amount of bending-down action for maximum challenge.

The circular handle 11 is preferably provided with a friction-grip surface, such as ridges or a sprayed coating, and for the men's model would have a median diameter of about 1⅛ inches; and with whatever minimum length of about 5¼ inches would accommodate those men with unusually large hands with just enough room to secure a good grip by allowing the heel of their hand to be in alignment with the tip of handle 11 when their one-handed grip is in the forwardmost position of curled forefinger pushed snug against inner stabilizer 14. In recognition of the fact that the more forward the grip, the lighter the effective load, an antifudging-of-grip rod 16, with a diameter of about ⅛ inch, extends outward about ¾ inch from opposite sides of handle 11 in vertical plane of inner stabilizer 14 to prevent anyone from fudging his grip by sliding his hand forward so that inner stabilizer 14 is between the curled middle finger and curled forefinger—a feature that is especially appreciated in an organized sport competition.

Near handle 11 is a pedestal 17 having its outer side positioned whatever minimum distance of about 1½ inches beyond the vertical plane of inner stabilizer 14 would provide just enough room for the protrusion of the longest of thumbs among those men using the thumb-on-top-parallel-to-pole style of one-handed grip as opposed to the compact curled-thumb-crosswise-of-pole style. A mast member 18, with a diameter of about ¼ inch, extends perpendicularly upward from pedestal 17, and has an upper outer arm 19 and a lower outer arm 20 each with a diameter of about 3/16 inch, and slanting upward from mast 18 relative to pole 10 in the same vertical plane as the axes of pole 10 and mast 18. Outer arms 19 and 20 are also parallel to each other to allow their respective rings 21 and 22 to slide simultaneously when pole 10 is tilted high enough. The upper outer arm 19 has a straight section about 1 inch long, and lower outer arm 20 also has a straight section, but it is somewhat longer than that of arm 19, just enough longer to require quick reflexes immediately after having dislodged upper outer ring 21 to avoid losing lower outer ring 22 with an instantaneous downward flick of the player's arm. Outer arms 19 and 20 have identical tips 23 and 24 respectively that curve downward to enable their respective rings 21 and 22 to be easily dislodged therefrom when pole 10 is tilted high enough. Inner arms 27 and 28 are similarly configured to enable their respective rings 29 and 30 to produce the same challenge when pole 10 is tilted low enough—the objective being to require a maximum degree of delicate dexterity in ring control on a pole for maximum challenge.

The upper outer ring 21 and lower outer ring 22 typically have an inside diameter of about ½ inch to provide easy dislodgement therefrom and rethreading thereon, and they are attached to one end of their respective retaining means 25 and 26, such as a chain (or lanyard), and with the other ends thereof attached to curved tips 23 and 24 respectively; and with their respective retaining means 25 and 26 providing no more slack than deemed necessary (the shorter and lighter the retaining means the less the drag on the sliding rings); and with a similar arrangement for inner arms 27 and 28 with their respective rings 29 and 30 and respective chains (or lanyards) 33 and 34. The purpose of the retaining means is to avoid what would otherwise be a repetitious nuisance of having to search the floor each time a ring dislodged.

Keeping in mind that the fundamental structural concept of Embodiment "A" (and all of the other embodiments) is to allow ball 13 to move first during the tilting action, then the weight discs 35, and finally the rings 21, 22, 29 and 30, the arms 19, 20, 27 and 28 and their respective rings 21, 22, 29 and 30 are of maximum smoothness at points of contact for minimum friction so that, when pole 10 is lying horizontally on a floor, the rings 21, 22, 29 and 30 when strung thereon would require only a minimum downward sloping of respective arms 19, 20, and 28 in order to slide automatically into correct position flush against the junctures as shown in FIG. 1—another feature that is especially appreciated in an organized sport competition. The twofold objective of having minimum sloping arms 19, 20, 27 and 28 relative to pole 10 is first, to generate maximum challenge by taking advantage of the fact that the closer pole 10 must be held to the horizontal in order to dislodge upper rings 21 and 29 the greater the effective weight of pole 10 and everything on it and thus the greater difficulty of maintaining control and, in the case of inner arms 27 and 28, to provide the shortest players with enough floor clearance when lowering pole 10 to dislodge upper inner ring 29, thereby avoiding the possibility of otherwise having to make pole 10 shorter than the ideal full length as previously cited. However, the minimum slope of outer arms 19 and 20 would be increased if necessary by whatever minimum amount would dictate during the tilting action that the weight discs 35 at opposite end of pole 10 would automatically slide all the way inward from their starting position and be slammed against cumulative-weight post 36 before upper outer ring 21 could be dislodged without also losing lower outer ring 22—the objective being to prevent any player from escaping this jarring threat to loss of lower ring 22 for maximum challenge—another feature that is especially appreciated in an organized sport competition.

With the junctures of upper arms 19 and 27 positioned about ½ inch below its top, mast member 18 is preferably of whatever minimum height would allow the junctures of lower arms 20 and 28 to be positioned so that when rings 21, 22, 29 and 30 are dislodged therefrom they would hang by their respective chains 25, 26, 33 and 34 with only about ½inch of clearance underneath—the objective being to have a mast member 18 no taller than would be necessary to provide all four rings 21, 22, 29 and 30 with an unobstructed freedom of movement—freewheeling along their slippery perches, freeswinging on their way downward, and freedangling at the end of their chains.

At the end of pole 10 opposite from handle 11 is an upstanding cumulative-weight post 36 with a diameter of about ¼ inch, and for maximum rigidity extending perpendicularly upward from its pedestal 37 to whatever minimum height would accommodate a weight disc 35 and a disc tab 52; and anchoring a three-part disc rod assembly F attached at the mid-point thereof. Each part of assembly F has a diameter of about 3/16 inch, the assembly comprising an inner disc rod segment 38 extending outward about 2½ inches in an upward slant relative to pole 10 to whatever minimum degree would allow any weight disc 35 hanging thereon to remain out of play during the tilting action until after ball 13 has safely arrived on outer ramp 44, thereby automatically becoming a sliding and slamming threat to loss of both inner rings 29 and 30; and with a second or outer disc rod segment 39 continuing outward about another 2½ inches but in a downward slant relative to pole 10; and with a third or upper disc rod segment 40 slanting upward relative to pole 10 to form a right-angle juncture with outer disc rod segment 39, and extending to a height of about ½ inch above top edge of weight discs 35; and with all three segments thereof in the same vertical plane as the longitudinal axis of pole 10. In view of the fact that, as previously mentioned, the less the outer disc rod segment 39 needs to slope the less the outer arms 19 and 20 of mast member 18 need to slope, therefore outer disc rod segment 39 slopes downward whatever minimum degree would dictate that when pole 10 is lying horizontally on a floor, any one or more weight discs 35 when strung thereon would automatically slide into their correct starting position flush against the outer juncture as shown in FIG. 1 to add maximum effective weight to pole 10—another feature that is especially appreciated in an organized sport competition. This minimum-slope objective is attained with a disc rod assembly F and weight discs 35 of maximum smoothness at points of contact for minimum friction. The three-part disc rod assembly F must also be strong enough and anchored securely enough to maintain proper alignment with pole 10 regardless of whether carrying only one of the weight discs 35 or a full load. Attaching disc rod assembly F to cumulative-weight post 36 as shown in FIG. 1 protects it from damage if a player allows pole 10 to swing downward and strike the floor—a protective feature that is especially appreciated during the intense competition of an organized sport.

The loading of one or more weight discs 35 on the outer end of pole 10 produces an instantaneous shifting of its balance point for the upcoming round, the greater the load the greater the shift; and a hole in their center provides a multimotional shifting of this new balance point as they slide inward and outward with minimum friction along disc rod assembly F in response to gravity during the tilting of pole 10, the farther they slide the greater the shift—the objective being to subject pole 10 to ever-greater sliding changes in downward pressure and effective weight with each fractional movement for maximum difficulty of control. Furthermore, a set of weight discs 35 are numbered numerically (not shown) to facilitate a quick and accurate scoring system as explained later. For example, with a full-length pole 10 for the men's model there is provided a set of 48 weight discs 35 each 1/64 inch thick and weighing ⅛ ounce, each set being ¾ inch thick and weighing 6 ounces.

A number of multiple full-load equivalents such as E are numbered numerically (not shown), and with each equal in effective weight to one or more sets of weight discs 35, and with each preferably in the form of a sphere 42 with a stem 43 for quick and easy attachment and removal by inserting into an anchoring hole drilled into the top of cumulative-weight post 36 that is of whatever minimum height as previously intimated would place sphere 42 just above the slamming reach of any incoming weight discs 35 and disc tabs 52—the objective being to enable pole 10 to register each time a player has coped with a set of weight discs 35. Thus a #1 full-load equivalent E would be of whatever weight would give pole 10 the same effective weight as would a set of weight discs 35 strung on outer disc rod segment 39, automatically dictating that it be somewhat heavier in actuality than a set of weight discs 35 to compensate for its closer-in position relative to pole 10. A #2 full-load equivalent E and a #3 full-load equivalent E would weigh exactly two and three times as much respectively as a #1 full-load equivalent E, and so on. Therefore, only one of them would ever be in use at any one time.

The longitudinal concave track 12 for ball 13 is a very shallow groove of maximum smoothness cut longitudinally into the top surface of pole 10 from a point as close to mast member 18 as possible to a point as close to cumulative-weight post 36 as possible (the longer the groove the greater the challenge), and extends all the way across pole 10 from edge to edge in the form of an arc of a circle for the ultimate in uniform curvature, and with a combination of whatever minimum width of about 1 inch and of whatever minimum edge-to-edge-/arc-of-a-circle curvature would create a track 12 so slippery that it would allow ball 13 rolling therein to drift off line the moment a player allows pole 10 to lean the least bit laterally, and thus overboard, unless he has sharp reflexes quick enough to take corrective action by rotating his arm on its axis— the objective being to require a maximum degree of delicate dexterity in lateral ball control on a pole for maximum challenge.

The inner and outer ends of slippery track 12 terminate in respective ramps (or pockets ) 41 and 44 sloping downward about 3 inches for an approaching ball 13 at an angle of about 5 degrees relative to the upper surface—the objective being to impart increased speed to ball 13 upon entering to enhance its chances of rebounding off pole 10 unless a quick counteraction is taken to slow it down with an instantaneous vertical flick of the player's arm for maximum challenge. At the end of ramps 41 and 44 are ball-ejecting members comprising respective walls 45 and 46 extending upward about 1 inch sufficient to stop a speeding ball 13; and they are positioned diagonally to the longitudinal axis of pole 10 at an angle of about 20 degrees so that their left sides relative to a player are closer to an approaching ball 13; and they also recline away from each other about 40 degrees off the vertical relative to the slope of respective ramps 41 and 44—the objective being to allow a speeding ball 13 to be lost by rebounding at an upward tangent off to the right side of pole 10 relative to a player. Furthermore, walls 45 and 46 are resilient to provide bounce to whatever maximum degree would dictate that ball 13 must hit each of them at minimum speed to avoid rebounding off pole 10—the objective being to require a maximum degree of delicate dexterity in vertical ball control on a pole for maximum challenge.

The ball 13 is of maximum uniformity and smoothness with a typical diameter of about ⅜ inch, and of whatever high density would give it a maximum practical weight to enable each of its rotations along slippery track 12 to impart to pole 10 a maximum shifting of its balance point, the farther it rolls the greater the shift—the objective being to subject pole 10 to an optimum amount of ever-greater rotational changes in downward pressure and effective weight with each rotation of ball 13 for maximum difficulty of control. Furthermore, ball 13 is made of a hard, nonbouncy substance that in conjunction with the aforesaid upward trajectory would require minimum effort in retrieving a rebounding lost ball 13 with minimum travel.

The disc dispenser G shown in FIG. 3 has a shank 47 with a diameter of about 1 inch and a length of about 6 ½ inches. A dispenser rod 48, with a diameter the same size as three-part disc rod assembly F, extends straight outward from opposite end of shank 47 to whatever minimum length would provide a set of weight discs 49 (a partial set shown cut-away) with only enough room for easy handling of whatever number of them are chosen by a player to be transferred to pole 10; and it then juts downward about 1 ¼ inches at an angle thereto of about 90 degrees in same vertical plane thereof, and with about ⅜ inch of its tip 50 slimmed for insertion into a snug-fitting hole drilled into the top of upper disc rod segment 40—the objective being to provide snag-free sliding of any size group of weight discs 49 across a smooth connection to load and unload pole 10 with maximum ease without ever having to stop to rethread them, thereby serving as a "rack with a track" while automatically reversing their numerical order correctly every time (top to bottom and bottom to top numerically on disc dispenser G and pole 10 respectively) another feature that is especially appreciated in an organized sport competition. A ground support member comprising a circular plate 51 with a flat bottom is attached perpendicularly to base of shank 47 to enable disc dispenser G to sit upright on a floor for easy access.

There are typically about a dozen oblong disc tabs 52 stored on disc dispenser G (of which most players in organized competition would likely need fewer than half), each with a hole in its center the same size as the hole in each weight disc 49, and of maximum smoothness at points of contact capable of sliding along on disc rod assembly F with minimum friction to facilitate the previously cited minimum downward slope of outer disc rod segment 39; each with a length about ½ inch greater than diameter of each weight disc 49 to provide an overlap of about ¼ inch on each side thereof; and each of the same weight as a weight disc 49 to emphasize the adverse significance of its dead weight in affecting a player's score.

A disc tab rod 53 with a diameter of about 3/16 inch and length of about 1 inch slants upward from top of shank 47 of disc dispenser G near and toward its outer end at an angle relative thereto of about 15 degrees off the vertical, thereby allowing it to slant upward about 15 degrees above the horizontal when disc dispenser G is sitting upright on the floor to enable it to retain the dozen or so disc tabs 52 stored thereon for quick and easy access, ready for a player to insert one of them on outer disc rod segment 39 after each round successfully completed in order to isolate all of his successfully completed rounds from the last load of weight discs 49 unable to be completed in the final round—the objective being to provide a quick and accurate determination of each player's total score, as explained below.

OPERATION OF EMBODIMENT "A" IN AN ORGANIZED COMPETITIVE SETTING

In a competition meet, with the four rings 21, 22, 29 and 30 hanging on mast member 18, and with ball 13 on outer ramp 44 of each of several hundred units of the in-line/ball-on sports device lined up side by side on the floor ready to go, each member of this particular entry division must first decide the maximum number of weight discs 49 on disc dispenser G that he dares to risk trying to tilt in round #1—with a double ditty ringing in his ears that says loud and clear, "The longer my test the lower my best because the longer I hold the sooner I fold". Therefore, in view of the fact that a #1 full-load equivalent E is only allowed to replace a set of weight discs 49 that has been successfully handled, a player who accomplishes this in round #1 has a big advantage over those players who, fearful of fouling out in the first round with a score of zero, decide to use two or more rounds in trying to reach that level even though at a progressively greater cost in expended strength compounded by having to face two or more times as many of the aforesaid 12 threats to loss of control while being further handicapped by the dead weight of the one or more disc tabs 52. In any case, after grasping disc dispenser G and inserting tip 50 of dispenser rod 48 into the hole in the top of upper disc rod segment 40, and after sliding his selected number of weight discs 49 onto segment 40 and then onto outer disc rod segment 39 as shown in FIG. 1, each player is now ready to discover for himself that this ball-on-a-pole sport does in fact give a player of superior dexterity/inferior strength at least six possible ways to outlift players of superior strength/inferior dexterity, as previously set forth.

With pole 10 lying on the floor, each player's objective is to bend down and with a grip of his choice, grasp handle 11 with one hand, then, while being careful not to lose ball 13 sideways off either edge of ramp 44, lift pole 10 horizontally off floor and straighten up to a standing position. Then, with an upward pivoting of the arm, tilt pole 10 high enough above horizontal to let ball 13 roll "up" outer ramp 44 and down slippery track 12, and then down inner ramp 41 after having been very careful all along the way not to let it drift laterally off either side of slippery track 12 or enter the downward slope of inner ramp 41 too fast to avoid rebounding off side of pole 10— threatened all along the way with runaway speed as each rotation of ball 13 reduces the effective weight of pole 10 with an ever-lessening downward pressure, thus triggering a natural tendency to tilt the ever-lighter-feeling pole 10 higher than intended which could propel ball 13 off pole 10. Then tilt pole 10 farther upward, and without losing ball 13 laterally off side of inner ramp 41, let upper outer ring 21 slide off its perch followed by an instantaneous downward flick of the arm to stop its onrushing companion ring 22 in time to avoid drop-off immediately after weight discs 35 have automatically completed their inward slide—not only further reducing the effective weight of pole 10 with an ever-lessening downward pressure the farther they slide to trigger again a natural tendency to tilt the ever-lighter-feeling pole 10 higher than intended which could propel both outer rings 21 and 22 off their perches, but also slamming against cumulative-weight post 36, the greater the load and the less the friction the greater the slamming and thus the jarring of player's hand, arm and shoulder to threaten again the loss of ball 13 from inner ramp 44 and both outer rings 21 and 22. Then, with a downward pivoting of the arm, tilt pole 10 low enough below horizontal to let ball 13 roll "up" inner ramp 41 and down slippery track 12, and then down outer ramp 44 after again having been very careful all along the way not to let it drift laterally off side of slippery track 12 or enter the downward slope of outer ramp 44 too fast to avoid rebounding off side of pole 10—threatened again all along the way with runaway speed as each rotation of ball 13 increases the effective weight of pole 10 with an ever-greater downward pressure, thus triggering a natural tendency to let the ever-heavier-feeling pole 10 tilt lower than intended which could propel ball 13 off pole 10. Then tilt pole 10 farther downward, and without losing ball 13 laterally off the side of outer ramp 44, let upper inner ring 29 slide off its perch followed by an instantaneous upward flick of the arm to stop its onrushing companion ring 30 in time to avoid drop-off immediately after weight discs 35 have automatically completed their outward slide—not only further increasing the effective weight of pole 10 with an ever-greater downward pressure the farther they slide to trigger again a natural tendency to let the ever-heavier-feeling pole 10 tilt lower than intended which could propel both inner rings 29 and 30 off their perches, but also slamming against upper disc rod segment 40 and thus jarring player's hand, arm and shoulder to threaten again the loss of ball 13 from outer ramp 44 and both inner rings 29 and 30. Then return pole 10 to floor and, after making certain that it is resting in an upright balanced position and won't topple laterally, release it carefully with ball 13 still on outer ramp 44, and with both lower rings 22 and 30 still intact. Any player having fouled out in whatever way returns immediately to his seat without doing anything else to pole 10. Each survivor (after inserting a disc tab 52 on outer disc rod segment 39, then inserting whatever additional number of weight discs 49 from disc dispenser G that he is willing to risk in round #2, and rehanging upper rings 21 and 29 on their respective arms 19 and 27) is now ready to begin round #2, and so on until he fouls out, upon which he returns immediately to his seat without doing anything else to pole 10.

The numerical order of weight discs 49 on disc dispenser G, the disc tabs 52, and the serial-numbered full-load equivalents E produce a very quick and accurate scoring system—recording each player's total score by the serial number of the full-load equivalent E on pole 10, if any, and by the serial number of the first weight disc 35 behind the first disc tab 52 relative to upper disc rod segment 40, thereby excluding the last load in the front thereof that was aborted in the final round. For example, if player "A" has no full-load equivalent E and weight disc #40 as defined above, and if player "B" has #1 full-load equivalent E and weight disc #26, and if player "C" has #2 full-load equivalent E and weight disc #5, their total scores would be 0–40, 1–26 and 2–05 respectively. Therefore, under this precise system of scoring, if a player decides not to try another round after successfully completing one or more rounds, he must nevertheless first insert a disc tab 52 and then one or more weight discs 49 on his outer disc rod segment 39 before returning to his seat in order to enable a scorekeeper to record his correct score.

The disc dispenser G and disc tab 52 combination makes the staging of an organized competition involving thousands of players a practical matter not only by requiring a minimum number of scorekeepers, but also by enabling them to record each player's total score quickly and accurately after having allowed each member of an entry division lined up side by side on the firing line to load his own pole 10 quickly and easily with whatever maximum number of weight discs 49 he dares to risk trying to tilt in each round while preventing his getting them out of numerical order, and in the process automatically reducing each player's performance time to the minimum by catering to his natural impulse to conserve physical strength by reaching his limit in as few rounds as possible. Thus, the disc dispenser G and disc tab 52 combination is the magic key offering the best of both worlds for all concerned, and without which any such staging would seem to be impractical from every standpoint—timewise, costwise, scoringwise. Furthermore, even in an informal game of fun between friends, this combination would have to be much appreciated for its speed, ease and accuracy in playing the game, thus making this tantalizing new sport that much more enjoyable.

DESCRIPTION OF EMBODIMENT "B"

The off-line/ball-on sports device shown in FIG. 2 transforms the in-line/ball-on sports device shown in FIG. 1 into a distinctly new challenge by the repositioning of handle 11 so that handle 54 extends horizontally outward from pole 55 midway of its length and perpendicular thereto. The triangular stabilizers 14 and 15 are replaced by cylindrical supports 56 and 57 each with a diameter of about ¼ inch and extending downward about 1 ½ inches at opposite ends of pole 55; and they become a threesome with cylindrical support 58 extending downward from outer end of midway handle 54 in same vertical plane with antifudging-of-grip rod 59. Furthermore, midway handle 54 allows pole 55 to be much longer by providing it with twice as much downward-tilting space, thereby allowing a much longer slippery track 60 for added challenge to both delicate dexterity and brute strength.

OPERATION OF EMBODIMENT "B"

The rules for playing the game with the off-line/ball-on sports device shown in FIG. 2 are exactly the same as described for the in-line/ball-on device shown in FIG. 1, but there are four fundamental differences in execution: (1) aside from the weight discs 119, and aside from the rings 61, 62, 63 and 64, a player controls the speed of ball 65 by rotating his arm on its axis instead of vertically pivoting his arm; (2) conversely, he corrects any lateral drifting of ball 65 by vertically pivoting his arm instead of rotating his arm on its axis; (3) each rotation of ball 65 on its outbound trip decreases the effective weight of pole 55 only until it reaches the point directly opposite midway handle 54 after which it increases the effective weight thereof, and likewise on its return trip; and (4) avoiding the loss of lower rings 62 and 64 is much more challenging because of their comparative remoteness from a player compounded by the practicality of a much longer pole 55 as cited above. Thus, a player who is proficient with the embodiment "A" sports device would not necessarily be proficient with the embodiment "B" sports device, and vice versa.

DESCRIPTION OF EMBODIMENT "C"

Figures 4, 5:
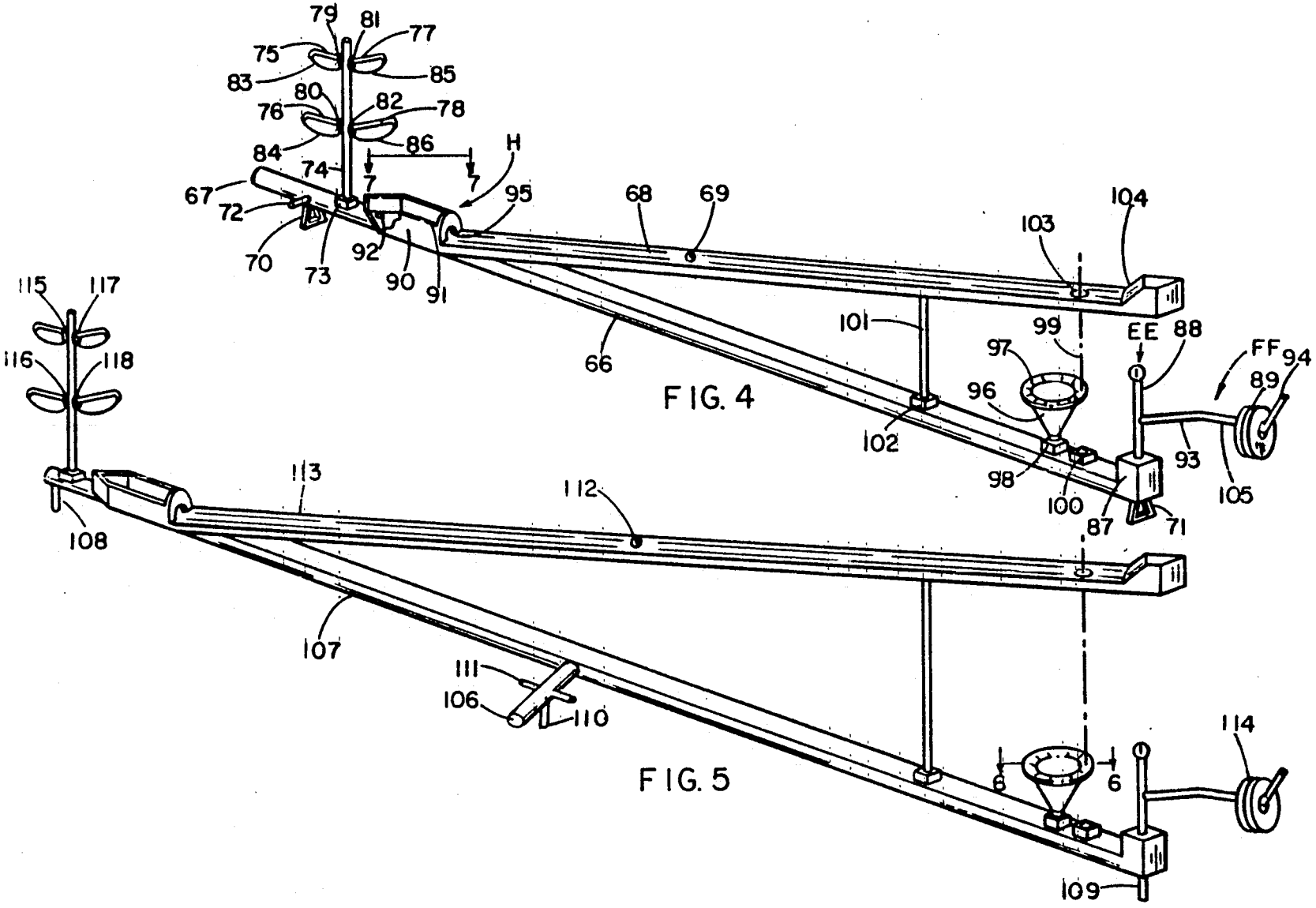
FIG. 4 is a perspective view of the in-line/ball-over embodiment "C" of the present sports device.
FIG. 5 is a perspective view of the off-line/ball-over embodiment "D" of the present sports device.
Figure 8:
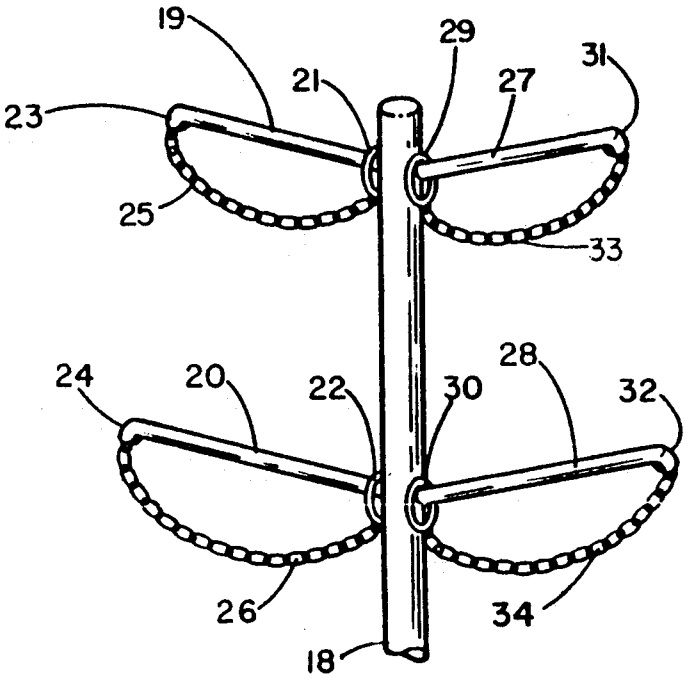
FIG. 8 is an enlarged pictorial view of the rings and support therefor shown in FIGS. 1,2,4 and 5.
Figure 7:
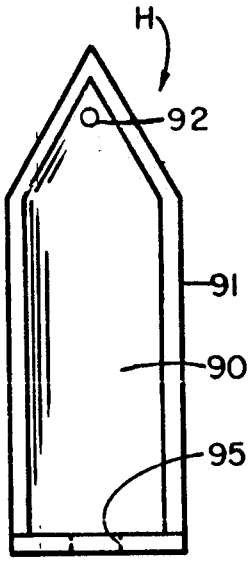
FIG. 7 is a view taken along line 7—7 of FIG. 4.

The in-line/ball-over sports device shown in FIG. 4 comprises an elongated member in the form of pole 66 with handle 67 at one end thereof in alignment therewith corresponding to handle 11 of the embodiment "A" sports device shown in FIG. 1, and supporting a longitudinal concave track 68 that is angularly disposed thereto by inclining upward therefrom in which to let ball 69 roll from one end to the other in response to gravity, and, as previously stated, the longer the pole the greater the challenge. However, if the degree of incline is severe rather than moderate, its optimum length for maximum challenge would necessarily have to be somewhat shorter than the optimum length for the embodiment "A" sports device in order to provide enough floor clearance for the steeper downward-tilting requirement needed to activate ball 69 "up" inclined track 68.

This embodiment "C" sports device has inner and outer stabilizers 70 and 71, antifudging-of-grip rod 72, pedestal 73 anchoring mast member 74 with outer arms 75 and 76 and inner arms 77 and 78, outer rings 79 and 80 and inner rings 81 and 82, outer chains 83 and 84 and inner chains 85 and 86, pedestal 87 anchoring cumulative-weight post 88, three-part disc rod assembly FF, weight discs 89, and full-load equivalents EE corresponding respectively to inner and outer stabilizers 14 and 15, antifudging-of-grip rod 16, pedestal 17 anchoring mast member 18 with outer arms 19 and 20 and inner arms 27 and 28, outer rings 21 and 22 and inner rings 29 and 30, outer chains 25 and 26 and inner chains 33 and 34, pedestal 37 anchoring cumulative-weight post 36, three-part disc rod assembly F, weight discs 35, and full-load equivalents E of the embodiment "A" sports device shown in FIG. 1.

The criteria for determining the correct amount of upward slope for outer arms 75 and 76 of mast member 74 is the same as previously cited for the corresponding arms of the embodiment "A" sports device, but in order to compensate for the necessarily greater downward tilting of pole 66 to activate ball 69 "up" inclined track 68, the correct amount of upward slope for inner arms 77 and 78 is whatever minimum amount would allow ball 69 to go out of play before inner rings 81 and 82 come into play—the objective being to avoid what would otherwise be unfairly asking a player to monitor the movements of all three simultaneously.

A grooveless section of pole 66 replaces the longitudinal concave track 12 of the embodiment "A" sports device to make room in part for an enclosure H for ball 69 comprising a flat deck 90 about 7 inches long and 2 inches wide enclosed by railing 91, and extending lengthwise along top of pole 66 beginning as close to mast member 74 as possible. A dimple 92 in flat deck 90 for anchoring ball 69 is centered close enough to the pointed outer end of railing 91 to prevent any backward movement of ball 69 therefrom when pole 66 is tilted upward to dislodge upper outer ring 79, and it is of whatever depth would dictate that when pole 66 is tilted downward the outbound ball 69 would leave dimple 92 before any weight discs 89 begin sliding outward on inner disc rod segment 93 that slopes upward relative to pole 66 to whatever degree would allow them to slam against upper disc rod segment 94 when ball 69 is about halfway "up" inclined track 68—the objective being to require a maximum degree of delicate dexterity in ball-jarring control over a pole for maximum challenge. The railing 91 (shown cut-away in FIG. 4) is about ½ inch tall except at its inner end which is heightened to about 1 inch to house bull's-eye #1 opening 95 in the form of a circular hole at the base of inclined track 68, and is only slightly larger in diameter than ball 69 to whatever minimum degree in conjunction with flat deck 90 would tolerate virtually no lateral leaning of pole 66 for maximum challenge in pinpoint accuracy—the objective being to reward a player who makes a straight-through shot with a ball 69 that could reach the summit of inclined track 68 while another ball 69 that drifted a bit off center line could still be floundering around looking frantically for the way out.

A funnel-shaped cup 96 typically has an overall height of about 5 inches, and has a diameter of about 3½ inches at top of its collar 97 and from the base of which its inward-slanting sides come downward to a point from which extends a stem for inserting into an inner anchoring hole preferably drilled obliquely into the top of inner pedestal 98 in an outward direction—the objective being to enable funnel-shaped cup 96 to lean inward toward handle 67 to whatever degree would position it upright relative to the trajectory 99 of ball 69 falling into it from a point directly above; and with its inner pedestal 98 positioned as close to outer end of pole 66 as possible for maximum jarring effect. The flat circular collar 97 with a width of about 1 inch juts outward from the slanting sides of funnel-shaped cup 96 at whatever specific angle in conjunction with the angle of the slanting sides would enable ball 69, after striking its outer edge from the point directly above, to dive-bomb pole 66 with maximum number of ricocheting to-and-fro jarrings for maximum challenge, as illustrated by dotted lines in FIG. 6; and funnel-shaped cup 96 is preferably made of whatever lightweight substance in conjunction with ball 69 would produce the sharpest to-and-fro series of staccato ringing sounds for maximum added effect. With outer pedestal 100 also positioned as close to end of pole 66 as possible for maximum jarring effect, an anchoring hole is drilled into its top with the same slant as the other one to allow ball 69 to fall into the center of funnel-shaped cup 96 straight to its bottom—the objective being to let ball 69 dive-bomb pole 66 with a pile-driving one-punch force for an alternate challenge.

The longitudinal concave track 68 for ball 69, supported by strut 101 with a diameter of about ⅛ inch extending upward from its pedestal 102 atop pole 66, begins at the base of bull's-eye #1 opening 95 and inclines upward in a straight line over pole 66 in same vertical plane thereof at an optimum angle that, with a men's full-length pole, would seem likely to be about 15 or 20 degrees relative thereto (the shorter the pole the greater the angle of incline may be while still providing enough floor clearance for the steeper downward-tilting requirement), and preferably reaches a length and height just as great as the compactness and close positioning of the other attachments would permit. As with the embodiment "A" sports device, the inclined track 68 is a very shallow groove of maximum smoothness cut longitudinally into its top surface from one end to the other, and extends all the way across thereof from edge to edge in the form of an arc of a circle for the ultimate in uniform curvature, and with a combination of whatever minimum width of about 1 inch and of whatever minimum edge-to-edge/arc-of-a-circle curvature would create a track 68 so slippery that it would allow ball 69 rolling therein to drift off line the moment a player allows pole 66 to lean the least bit laterally, and thus overboard, unless he has sharp reflexes quick enough to take corrective action by rotating his arm on its axis—the objective being to require a maximum degree of delicate dexterity in lateral ball control over a pole for maximum challenge.

Figure 6:
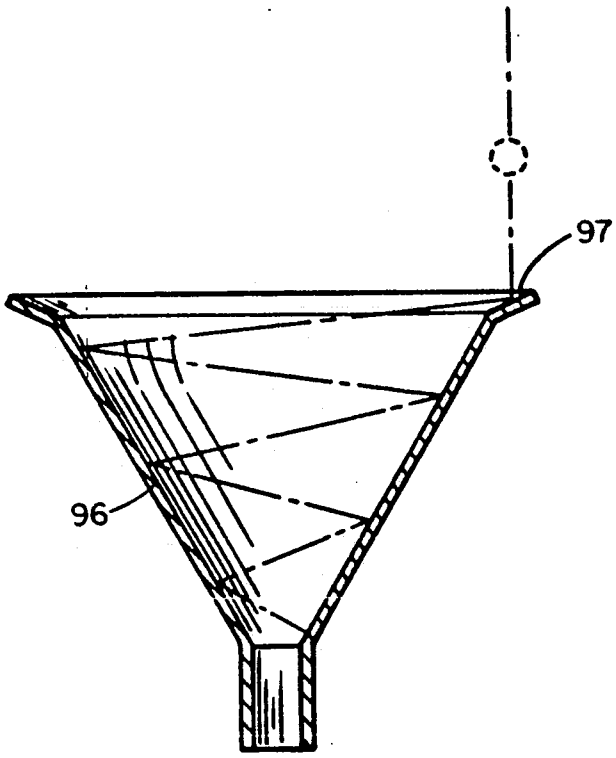
FIG. 6 is an enlarged sectional view taken along line 6—6 of FIG. 5.

A bull's-eye #2 opening 103 in the form of a circular hole is positioned near the summit of inclined slippery track 68 so that ball 69 dropping therethrough and falling straight downward would dive-bomb pole 66 either with a ricocheting action as shown in FIG. 6, or with a pile-driving one-punch force when funnel-shaped cup 96 is inserted into the anchoring hole atop outer pedestal 100. The bull's-eye #2 opening 103 is only slightly larger in diameter than ball 69 to whatever minimum degree would only receive ball 69 on center line, and only at minimum speed to avoid jumping over it—the objective being to require a maximum degree of delicate dexterity in lateral/vertical ball control over a pole for maximum challenge.

The outer end of inclined slippery track 68 terminates with a ball-ejecting member comprising a wall 104 located about 1 inch beyond bull's-eye #2 opening 103, and extends upward about 1 inch sufficient to stop a speeding ball 69; and it is positioned diagonally to the longitudinal axis of inclined slippery track 68 at an angle of about 20 degrees so that its left side relative to a player is closer to an approaching ball 69; and it also reclines away from an approaching ball 69 about 40 degrees off the vertical relative to inclined slippery track 68 the objective being to allow a speeding ball 69 to be lost by rebounding from wall 104 at an upward tangent off right side of pole 66 relative to a player. Furthermore, wall 104 is resilient to provide bounce to whatever maximum degree would dictate that a ball 69 overshooting bull's-eye #2 opening 103 must do so at minimum speed to remain in play for maximum challenge—the objective being to reward a very gentle bounce by giving a player a second chance to nudge ball 69 into bull's-eye #2 opening 103.

This embodiment "C" sports device prefers a ball 69 as previously described for the embodiment "A" sports device, but in addition it is preferably made of whatever substance within those guidelines, in conjunction with funnel-shaped cup 96, enables it to dive-bomb pole 66 with the aforesaid sharpest to-and-fro series of staccato ringing sounds for maximum added effect.

OPERATION OF EMBODIMENT "C" IN AN ORGANIZED COMPETITIVE SETTING

In a competition meet, with the four rings 79, 80, 81 and 82 hanging on mast member 74, with funnel-shaped cup 96 inserted into the anchoring hole atop inner pedestal 98 as shown in FIG. 4, and with ball 69 sitting in dimple 92 of each of several hundred units of the in-line/ball-over sports device lined up side by side on the floor ready to go, each member of this particular entry division must likewise first decide the maximum number of weight discs 49 on disc dispenser G that he dares to risk trying to tilt in round #1—with a double ditty likewise ringing in his ears that says loud and clear, "The longer my test the lower my best because the longer I hold the sooner I fold". Therefore, in view of the fact that, as with the embodiment "A" sports device, a #1 full-load equivalent EE is only allowed to replace a set of weight discs 49 that has been successfully handled, a player who accomplishes this in round #1 likewise has a big advantage over those players who, fearful of fouling out in the first round with a score of zero, decide to use two or more rounds in trying to reach that level even though at a progressively greater cost in expended strength compounded by having to face two or more times as many of the aforesaid 12 threats to loss of control while being further handicapped by the dead weight of the one or more disc tabs 52. In any case, after grasping disc dispenser G and inserting tip 50 of dispenser rod 48 into the hole in the top of upper disc rod segment 94, and after sliding his selected number of weight discs 49 onto segment 94 and then onto outer disc rod segment 105 as shown in FIG. 4, each player is now ready to discover for himself that this ball-over-a-pole sport likewise does in fact give a player of superior dexterity/inferior strength at least six possible ways to outlift players of superior strength/inferior dexterity, as previously set forth.

With pole 66 lying on the floor, each player's objective is to bend down and with a grip of his choice, grasp handle 67 with one hand, then lift pole 66 horizontally off floor and straighten up to a standing position. Then, with an upward pivoting of the arm, tilt pole 66 high enough above horizontal to let upper outer ring 79 slide off its perch followed by an instantaneous downward flick of the arm to stop its onrushing companion ring 80 in time to avoid drop-off immediately after weight discs 89 have automatically completed their inward slide—not only reducing effective weight of pole 66 with an ever-lessening downward pressure the farther they slide to trigger a natural tendency to tilt the ever-lighter-feeling pole 66 higher than intended which could propel both outer rings 79 and 80 off their perches, but also slamming against cumulative-weight post 88, the greater the load and the less the friction the greater the slamming and thus the jarring of player's hand, arm and shoulder to threaten again the loss of both outer rings 79 and 80. Then, with a downward pivoting of the arm, tilt pole 66 low enough below horizontal to let ball 69 roll out of dimple 92 and, immediately upon entering bull's-eye #1 opening 95, quickly tilt pole 66 farther downward with a flick of the arm to let ball 69 begin rolling "up" inclined slippery track 68 as weight discs 89 automatically begin sliding outward, being very careful all along the way not to let ball 69 drift laterally off either side of inclined slippery track 68, or approach bull's-eye #2 opening 103 too fast to avoid overshooting it—threatened all along the way with runaway speed as each rotation of ball 69 and each fractional sliding of each weight disc 89 simultaneously increase the effective weight of pole 66 with an ever-greater downward pressure, thus triggering a natural tendency to let the ever-heavier-feeling pole 66 tilt lower than intended which could propel ball 69 too fast to avoid rebounding off pole 66 after having been bombarded midway up inclined slippery track 68 by weight discs 89 slamming against upper disc rod segment 94, and thus again jarring player's hand, arm and shoulder to threaten loss of ball 69 and both inner rings 81 and 82. Then let ball 69 enter bull's-eye #2 opening 103 and fall straight downward, dive-bombing pole 66 with a sudden sharp increase in downward pressure upon striking outer edge of collar 97 of funnel-shaped cup 96 that, if not resisted, could drive pole 66 farther downward low enough to propel both inner rings 81 and 82 off their perches while again jarring player's hand, arm and shoulder, and then ricocheting to and fro several times against the sides of funnel-shaped cup 96 with sharp staccato ringing sounds of disconcerting intensity combined with additional jarring action to threaten again the loss of both inner rings 81 and 82. Then tilt pole 66 farther downward to let upper inner ring 81 slide off its perch followed by an instantaneous upward flick of the arm to stop its onrushing companion ring 82 in time to avoid drop-off. Then return pole 66 to floor and, after making certain that it is resting in an upright balanced position and won't topple laterally, release it carefully with both lower rings 80 and 82 still intact, and with ball 69 in funnel-shaped cup 96. Any player having fouled out in whatever way returns immediately to his seat without doing anything else to pole 66. Each survivor (after inserting a disc tab 52 on outer disc rod segment 105, then inserting whatever additional number of weight discs 49 from disc dispenser G that he is willing to risk in round #2, rehanging the two upper rings 79 and 81 on their respective arms 75 and 77, and returning ball 69 to dimple 92) is now ready to begin round #2, and so on until he fouls out, upon which he returns immediately to his seat without doing anything else to pole 66.

DESCRIPTION OF EMOBIDMENT"D"

The off-line/ball-over sports device shown in FIG. 5 likewise transforms the in-line/ball-over sports device shown in FIG. 4 into a distinctly new challenge by the repositioning of handle 67 so that handle 106 extends horizontally outward from pole 107 midway of its length and perpendicular thereto. The triangular stabilizers 70 and 71 are likewise replaced by cylindrical supports 108 and 109 each with a diameter of about ½ inch and extending downward about 1½ inches at opposite ends of pole 107; and they likewise become a threesome with cylindrical support 110 extending downward from outer end of midway handle 106 in same vertical plane with antifudging-of-grip rod 111. Furthermore, midway handle 106 likewise allows pole 107 to be much longer by providing it with twice as much downward-tilting space for added challenge to both delicate dexterity and brute strength, thereby making it possible for ball 112 to dive-bomb pole 107 with much greater force by allowing slippery track 113 to reach a much greater height in one of three ways: (1) increasing the angle of the incline; (2) increasing the length of the pole; and (3) a combination of the two.

OPERATION OF EMBODIMENT "D"

The rules for playing the game with the off-line/ball-over sports device shown in FIG. 5 are exactly the same as described for the in-line/ball-over sports device shown in FIG. 4, but there are likewise four fundamental differences in execution: (1) aside from the weight discs 114, and aside from the rings 115, 116, 117 and 118, a player controls the speed of ball 112 by rotating his arm on its axis instead of vertically pivoting his arm; (2) conversely, he corrects any lateral drifting of ball 112 by vertically pivoting his arm instead of rotating his arm on its axis; (3) each rotation of ball 112 on its one-way trip decreases the effective weight of pole 107 only until it reaches the point directly opposite midway handle 106 after which it increases the effective weight thereof; and (4) avoiding the loss of lower rings 116 and 118 is likewise much more challenging because of their comparative remoteness from a player compounded by the practicality of a much longer pole 107 as cited above. Thus, a player who is proficient with the embodiment "C" sports device would not necessarily be proficient with the embodiment "D" sports device, and vice versa.

DESCRIPTION AND OPERATION OF EMBODIMENT "E"

The rules of playing the game with the electrically-operated indicating mechanism of this embodiment are exactly the same as those of the previously described embodiments. However, in this embodiment the dislodgable rings and the ring supports are replaced by an electrically operated system of indicating when the allowable amount of tilt has been reached or exceeded.

Figure 9:
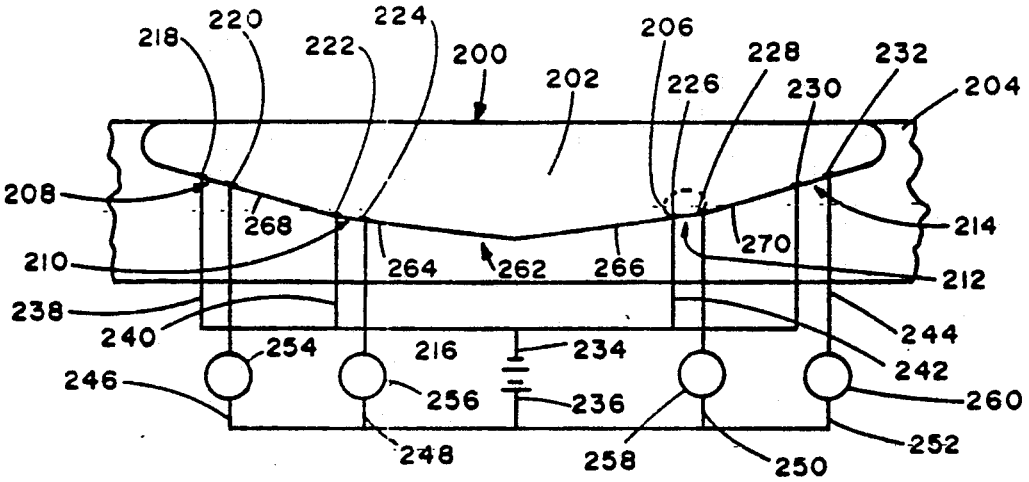
FIG. 9 is a diagrammatic view of an alternative system for indicating when a predetermined tilt of the present sports device has been reached or exceeded.

FIG. 9 illustrates an indicating system 200 which includes a "bubble" arrangement, somewhat similar to a carpenter's level, used in conjunction with the principles of a mercury switch. As seen in FIG. 9, the indicating system includes a cavity 202 provided in a member 204 (which may be the handle or other parts of the pole). The cavity should be easily seen by the individual using the pole. A ball of mercury 206 is provided in the cavity for movement along the length thereof. The cavity includes four pairs of electrical contacts 208, 210, 212 and 214, each pair connected to a light bulb (or buzzer or bell) and to a source of electrical energy 216 (illustrated in FIG. 9 as a battery). The pair of contacts 208 includes spaced contacts 218 and 220; the pair of contacts 210 includes spaced contacts 222 and 224; the pair of contacts 212 includes spaced contacts 226 and 228; and the other pair of contacts 214 includes spaced contacts 230 and 232. One contact of each pair is connected to one terminal 234 of the battery and the second contact of each pair is connected to the other battery terminal 236. For example, contacts 218, 222, 226 and 230 are shown connected to terminal 234 by electrical lines 238, 240, 242 and 244, respectively. Contacts 220, 224, 228 and 232 are shown to be connected to terminal 236 by electrical lines 246, 248, 250 and 252, respectively. The drawing illustrates that lights 254, 256, 258 and 260 are provided in the circuit. Obviously, the lights may be replaced by a buzzer or bell or used in conjunction therewith.

The embodiments shown in FIGS. 9–13 replace the ring assembly (which indicates when the desired and undesired tilt is achieved by dropping the upper and lower rings) with an electronic system which would indicate (by flashing lights, ringing bells, etc.) when the desired tilt is achieved by flashing the lights (green for go) 256 and 258 or by flashing the lights 254 and 260 (red for "foul") when the tilt of the pole is excessive. The "bubble" assembly is to be mounted so that the inner sets 210 and 212 of the contacts would be engaged (switch closed) by the ball of mercury at the same amount of tilt of the pole that would have been required to dislodge the upper rings. Likewise, the outer contacts 208 and 214 would be engaged (switch closed) by the ball of mercury by the same amount of tilt that would be required to dislodge the lower rings. In order to keep the length of the bubble cavity as short as possible the bubble assembly may be provided with lower surfaces which may be "tilted" or angularly disposed so that the mercury may position itself across a predetermined pair of contacts responsive to a predetermined tilt of the pole. For example, as seen in FIG. 9, the lower surface 262 of the bubble assembly is provided with a pair of angled surfaces 264 and 266, each surface being angled relative to one another and also to respective adjacent surfaces 268 and 270. Obviously, the switch is closed when the mercury is in contact with each contact of a pair of contacts. FIG. 9, for example, shows the contacts 226 and 228 of pair of contacts 212 as being engaged by the mercury to complete the circuit and "close the switch" causing green light 258 to be energized.

Figure 10:
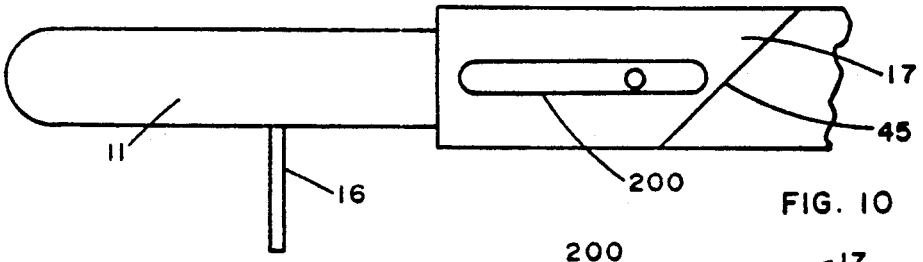
FIGS. 10 and 11 are plan and elevational views illustrating the position of the system of FIG. 9 being adjacent the handle when the handle is on the end of the present sports device.
Figure 11:
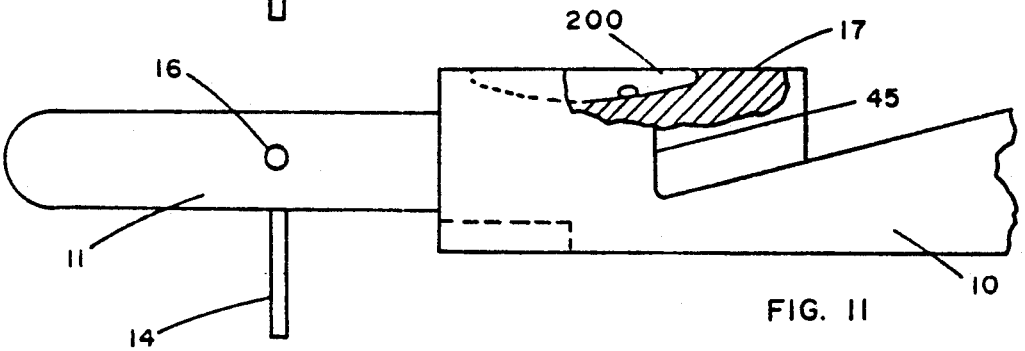
Figure 12:
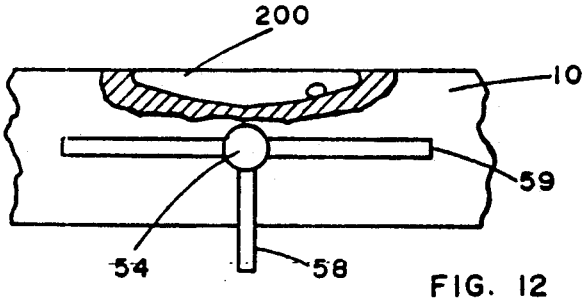
FIG. 12 is an elevational view illustrating the position of the system of FIG. 9 being adjacent the handle when the handle is along the length of the present sports device.
Figure 13:
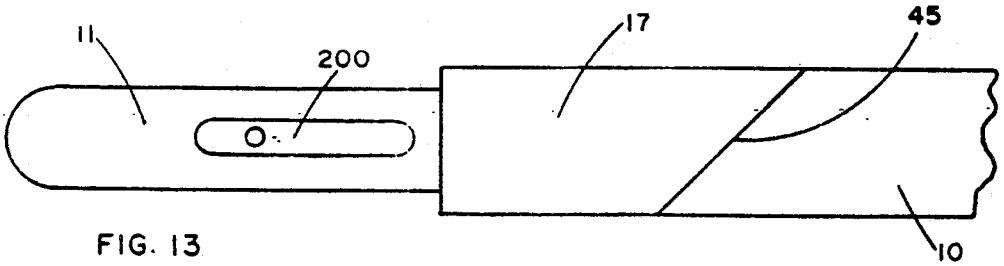
FIG. 13 is a view similar to FIG. 10 showing the system of FIG. 9 being positioned in the handle of the present sports device.

The "bubble assembly" may be mounted in the back part of the handle, as shown in FIG. 13, (which would have to be extended slightly), or the "bubble assembly" may be positioned as shown in FIGS. 10 and 11 which is positioned as the ring and pole assembly described previously and shown in FIGS. 1, 2 and 4, 5. For the embodiments shown in FIGS. 2 and 5, the bubble assembly may be positioned adjacent the handles as shown in FIG. 12. Small batteries to power the system may be mounted in a compartment below the "bubble assembly" as shown in FIG. 11 or in any other convenient location.

Obviously, many types of arrangements may be used to indicate the scoring or "fouling" on a remote scoreboard which is positioned for spectators to see. For example, the device may be plugged into a source of electrical power and the lights (or buzzers or bells) mounted on an external "scoreboard", instead of on the pole, which has been secured to a wall, stand, etc. Or, the lights may be mounted directly on the distant end of the pole adjacent to or on post 36 (FIGS. 1 and 2). Likewise, the lights may be mounted on the distant end of the pole adjacent surface 104 (FIG. 4). Of course, the lights may be mounted in the same position that the ring and pole assembly is mounted as shown in FIGS. 1, 2 and 4, 5.

ALTERNATIVE EMBODIMENTS

While the above description contains many specifications, these are not be be construed as limitations on the scope of my invention, but only as illustrations of several preferred embodiments thereof. A number of other embodiments are possible. For example, each of the two ball-on-a-pole embodiments "A" and "B" could be modified into a 2-track/4-ramp/2-ball model in which the two additional ramps would be positioned back-to-back midway of the pole—thereby producing another rousing gamesmanship to let the two balls roll simultaneously, thus with each ball making a round trip covering only half of the pole. For another example, each of the two ball-over-a-pole embodiments "C" and "D" could be modified into a 2-track/2-enclosure/2-cup/2-ball model in which the additional cup and enclosure would be positioned back-to-back midway of the pole—thereby producing another rousing gamesmanship to let the two balls roll simultaneously, thus with each ball going through its own bull's-eye #1 opening, then "up" its own inclined slippery track, and dropping through its own bull's-eye #2 opening into its own cup, thereby dive-bombing the pole at virtually the same instant. Furthermore, there are numerous possible design changes in the individual components of each of the various embodiments capable of performing the same function as the specific ones herein described. Accordingly, the scope of my invention is to be determined only by the appended claims and their legal equivalents.

SUMMARY OF THE ACHIEVEMENTS OF THE OBJECTS OF THE INVENTION

It is readily apparent from the foregoing that I have presented a tantalizing sports device so unique and challenging that it razzle-dazzles the weightlifting record down to almost zero with a dozen booby traps that demand the coordination of both delicate dexterity and brute strength every moment along the way from gentle liftoff to gentle touchdown; that it is amenable to the regular staging of an organized sport competition that offers physical fitness enthusiasts of all ages and levels at least six possible ways to outlift physically stronger competitors; that it can be manufactured in various sizes for men, women or children for their personal use and enjoyment; that it incorporates simplicity of design with economical and quality construction; and that it provides a long service life with normal use and care.

What is claimed is:

1. A sports device comprising:

an unconstrained elongated support means freely liftable manually from its resting place, and disposed for tilting movement while in its lifted position;

a handle fixed to said elongated support means for gripped relation by an individual to effect said lifting and tilting movement;

weight shifting means responsive to said tilting movement for changing the balance point of said elongated support means to vary the difficulty of manually tilting said elongated support means; and weight receiving means fixed adjacent to one end of said elongated support means to receive and support said weight shifting means during said manual tilting of said elongated support means.

2. The sports device of claim 1 wherein said weight receiving means is adapted to allow said weight shifting means to be displaced in response to gravity during the said manual tilting of said elongated support means to impart thereto a motional change in its balance point and effective weight with a downward pressure that varies with each fractional movement of said weight shifting means to maximize the difficulty of controlling the said manual tilting of said elongated support means.

3. The sports device of claim 2 wherein said handle and said weight receiving means are positioned at opposite ends of said elongated support means to dictate that the said displacement of said weight shifting means is induced manually by the vertical pivoting of said elongated support means.

4. The sports device of claim 2 wherein said weight receiving means is positioned at one end of said elongated support means and said handle is angularly disposed to said elongated support means at some point intermediate its length to dictate that the said displacement of said weight shifting means is induced manually by the rotating of said handle on its axis.

5. The sports device of claim 2 wherein said weight shifting means comprises one or more weights, each movably attached to said weight receiving means in which said displacement comprises an inward and outward movement.

6. The sports device of claim 5 wherein said one or more weights comprises one or more weight discs, each provided with a hole in its center for engagement with said weight receiving means, and wherein said weight receiving means comprises a cumulative-weight post fixed to and extending upward from said elongated support means, and a disc rod assembly arm extending outward therefrom, said arm being adapted to receive said weight discs loosely thereon and removably therefrom.

7. The sports device of claim 6 wherein said disc rod assembly arm comprises an inner rod segment, an intermediate rod segment, and an outer rod segment to regulate said inward and outward movements of said one or more weight discs.

8. The sports device of claim 7 wherein said outer rod segment of said disc rod assembly arm is provided with a hole in its top to facilitate the transferal thereon and removal therefrom of said one or more weight discs.

9. The sports device of claim 8 including a number of full-load equivalent weight members and wherein said cumulative-weight post is provided with a hole in its top to removably receive and support individually each said full-load equivalent weight member having the same effective weight as one or more sets of said weight discs to accommodate any number of rounds of play.

10. The sports device of claim 9 wherein each said full-load equivalent weight member comprises a generally spherical shape with a stem member adapted to be received in said hole in said cumulative-weight post.

11. The sports device of claim 1 including a support member secured on said elongated support means, and one or more mobile elements carried on said support member, predetermined ones of said mobile elements disposed for dislodgement from said support member in response to a predetermined tilt of said elongated support means.

12. The sports device of claim 11 further comprising restraining means for limiting the said dislodgement of said one or more mobile elements.

13. The sports device of claim 11 wherein said support member comprises a mast member extending upward from said elongated support means adapted to receive said one or more mobile elements at an elevated location.

14. The sports device of claim 13 wherein said mast member further comprises one or more arms extending outward therefrom each of which supports a said mobile element thereon.

15. The sports device of claim 14 wherein each said mobile element comprises a ring hanging loosely and removably on each said outwardly extending arm.

16. The sports device of claim 15 wherein each said outwardly extending arm has a curved tip to facilitate the said dislodgement therefrom of a said ring.

17. The sports device of claim 12 wherein said restraining means comprises one or more chains, one end of which is attached to each said ring and the other end thereof being attached to said curved tip of each said outwardly extending arm to limit its said dislodgement therefrom.

18. The sports device of claim 1 further comprising a track extending along the upper surface of said elongated support means, and a ball adapted for rolling movement in said track in response to gravity during the said manual tilting of said elongated support means to maximize the difficulty of controlling the said tilting movement of said elongated support means by imparting thereto a motional change in its balance point and effective weight with a downward pressure that varies with each rotation of said ball.

19. The sports device of claim 18 wherein the upper surface of said track has a longitudinal concave configuration.

20. The sports device of claim 18 further comprising a ball-ejecting member at each end of said track contoured to eject a speeding said ball therefrom responsive to impact of said ball therewith, said speeding of said ball being the result of excessive said manual tilting of said elongated support means.

21. The sports device of claim 20 wherein each said ball-ejecting member further comprises a bouncy resilient wall having a face reclined away from and diagonal to the longitudinal axis of said track to enable a said ball with a minimum rolling movement to be ejected from said track for maximum difficulty of control.

22. The sports device of claim 20 further comprising ramp means positioned intermediate said track and said ball-ejecting members, said ramp means having a downward slope to increase the speed of said ball passing thereover to further enhance the chances of said ball being ejected from said track.

23. The sports device of claim 18 wherein said elongated support means includes a pair of elongated members, the first of said pair of elongated members having said track thereon and being joined to and disposed in angular relation to the second of said pair of elongated members, said track having first and second ends.

24. The sports device of claim 23 wherein said angularly-disposed track is provided with an upper surface having a longitudinal concave configuration.

25. The sports device of claim 23 wherein said angularly-disposed track is provided with an opening adjacent said second end thereof, and said second of said pair of elongated members is provided with a receptacle thereon, said receptacle being positioned beneath said opening in the first of said pair of elongated members for receiving a said ball falling through said opening.

26. The sports device of claim 25 further comprising a ball-ejecting member at the said second end of said angularly-disposed track beyond said opening, and contoured to eject a speeding said ball therefrom responsive to impact of said ball therewith, said speeding of said ball being the result of excessive said manual tilting of said elongated support means.

27. The sports device of claim 26 wherein said ball-ejecting member further comprises a bouncy resilient wall having a face reclined away from and diagonal to the longitudinal axis of said track to enable a said ball with a minimum rolling movement to be ejected from said track for maximum difficulty of control.

28. The sports device of claim 23 further comprising an enclosure adjacent said first end of said angularly-disposed track, said enclosure having an opening therein aligned with said track and through which said ball must pass to enter said track.

29. The sports device of claim 28 wherein said enclosure is provided with a flat interior floor surface having a dimple therein for receiving and anchoring said ball.

30. The sports device of claim 1 further comprising one or more ground support members fixed to the underside of said elongated support means to provide it with stability and floor clearance to permit grasping of said handle when said elongated support means is resting on a planar surface.

31. The sports device of claim 1 wherein said handle has an antifudging-of-grip member to limit the forward placement of a player's hand on said handle to prevent reduction in the effective weight of said elongated support means.

32. The sports device of claim 8 further comprising weight dispenser means for quickly and easily transferring said weight shifting means to and from said elongated support means in a controlled and orderly manner.

33. The sports device of claim 32 wherein said weight dispenser means comprises an auxiliary disc dispenser providing a ground support base member, a shank upstanding from said base member, a curved dispenser rod extending outward from said shank, said rod provided with an upper part having a tip thereon, said tip being of lesser cross-section than said upper part and disposed for manual insertion into said hole in said top of said outer rod segment of said disc rod assembly arm of said elongated support means.

34. The sports device of claim 33 wherein said disc dispenser is further provided with a plurality of disc tabs, each with a hole therein for storing on said shank, whereby said tabs each in conjunction with said weight discs provide a quick and accurate system of determining a player's total score by isolating any aborted last load of said weight discs on said elongated support means.

35. A sports device comprising:

an unconstrained elongated support means freely liftable manually from its resting pace, and disposed for manual tilting movement while in its lifted position, said elongated support means supporting a single track extending along the upper surface thereof;

a ball adapted for rolling movement in said track in response to gravity during the said manual tilting of said elongated support means to maximize the difficulty of controlling the said tilting movement of said elongated support means by imparting thereto a motional change in its balance point and effective weight with a downward pressure that varies with each rotation of said ball;

a ball-ejecting member at each end of said track contoured to eject a speeding said ball therefrom responsive to impact of said ball therewith, said speeding of said ball being the result of excessive said manual tilting of said elongated support means; and a handle fixed to said elongated support means to enable a player to control the speed and direction of said rolling movement of said ball by said manual tilting of said elongated support means.

36. The sports device of claim 35 wherein the upper surface of said track has a longitudinal concave configuration.

37. The sports device of claim 35 wherein said handle is positioned at one end of said elongated support means to dictate that the speed of said rolling movement of said ball in said track is controlled manually by the vertical pivoting of said elongated support means.

38. The sports device of claim 35 wherein said handle is angularly disposed to said elongated support means at a point intermediate its length to dictate that the speed of said rolling movement of said ball in said track is controlled manually by the rotating of said handle on its axis.

39. The sports device of claim 35 wherein each said ball-ejecting member further comprises a bouncy resilient wall having a face reclined away from and diagonal to the longitudinal axis of said track to enable a said ball with a minimum rolling movement to be ejected from said track for maximum difficulty of control.

40. The sports device of claim 35 further comprising ramp means positioned intermediate said track and said ball-ejecting members, said ramp means having a downward slope to increase the speed of said ball passing thereover to further enhance the chances of said ball being ejected from said track.

41. The sports device of claim 35 wherein said elongated support means includes a pair of elongated members, the first of said pair of elongated members having said track thereon and being joined to and disposed in angular relation to the second of said pair of elongated members, said track having first and second ends.

42. The sports device of claim 41 wherein said angularly-disposed track is provided with an upper surface having a longitudinal concave configuration.

43. The sports device of claim 41 wherein said angularly-disposed track is provided with an opening adjacent said second end thereof, and said second of said pair of elongated members is provided with a receptacle thereon, said receptacle being positioned beneath said opening in the first of said pair of elongated members for receiving a said ball falling through said opening.

44. The sports device of claim 43 further comprising a ball-ejecting member at the said second end of said angularly-disposed track beyond said opening, and contoured to eject a speeding said ball therefrom responsive to impact of said ball therewith, said speeding of said ball being the result of excessive said manual tilting of said elongated support means.

45. The sports device of claim 44 wherein said ball-ejecting member further comprises a bouncy resilient wall having a face reclined away from and diagonal to the longitudinal axis of said track to enable a said ball with a minimum rolling movement to be ejected from said track for maximum difficulty of control.

46. The sports device of claim 41 further comprising an enclosure adjacent said first end of said angularly-disposed track, said enclosure having an opening therein aligned with said track and through which said ball must pass to enter said track.

47. The sports device of claim 46 wherein said enclosure is provided with a flat interior floor surface having a dimple therein for receiving and anchoring said ball.

48. The sports device of claim 35 including a support member secured on said elongated support means, and one or more mobile elements carried on said support member, predetermined ones of said mobile elements disposed for dislodgement from said support member in response to a predetermined tilt of said elongated support means.

49. The sports device of claim 48 further comprising restraining means for limiting the said dislodgement of said one or more mobile elements.

50. The sports device of claim 48 wherein said support member comprises a mast member extending upward from said elongated support means and adapted to receive said one or more mobile elements at an elevated location.

51. The sports device of claim 50 wherein said mast member further comprises one or more arms extending outward therefrom each of which supports a said mobile element thereon.

52. The sports device of claim 51 wherein each said mobile element comprises a ring hanging loosely and removably on each said outwardly extending arm.

53. The sports device of claim 51 wherein each said outwardly extending arm has a curved tip to facilitate the said dislodgement therefrom of a said ring.

54. The sports device of claim 49 wherein said restraining means comprises one or more chains, one end of which is attached to each said ring and the other end thereof being attached to said curved tip of each said outwardly extending arm to limit its said dislodgement therefrom.

55. The sports device of claim 35 further comprising one or more ground support members fixed to the underside of said elongated support means to provide it with stability and floor clearance to permit grasping said handle when said elongated support means is resting on a planar surface.

56. The sports device of claim 35 wherein said handle has an antifudging-of-grip member to limit the forward placement of a player's hand on said handle to prevent reduction in the effective weight of said elongated support means.

57. A sports device comprising:

an elongated support means disposed for manual tilting movement;

a handle fixed to said elongated support means for said manual tilting thereof;

weight shifting means secured to said elongated support means and disposed for changing the balance point of said elongated support means responsive to said manual tilting thereof;

a ball disposed for controlled movement along a prescribed path on said elongated support means;

ejecting means for ejecting said ball from said elongated support means responsive to said ball exceeding a predetermined velocity as a result of excessive said tilting movement being manually imparted to said elongated support means; and indicating means for signaling when said tilting movement reaches a first predetermined limit and for also signaling when said tilting movement reaches a second predetermined limit.

58. The sports device as set forth in claim 57 wherein said indicating means comprises:

a level indicator secured to said elongated member, said level indicator including a cavity having a plurality of electrical contacts mounted therein in pairs including two inner pairs and two outer pairs, an electrically- conductive movable member carried in said cavity for movement along the length of said cavity responsive to said tilting motion of said elongated member, a source of electric power connected to said electrical contacts, said electrical contacts disposed for providing first and second signal outputs responsive to engagement of said movable conductive member respectively with a said inner pair of electrically conductive members and with a said outer pair of said electrically conductive members; and signal means connected to said inner and outer pairs of electrical conductors for indicating which said pairs are being contacted by said conductive movable member.

59. The sports device as set forth in claim 58 wherein said electrically-conductive movable member is a ball of mercury.

60. The sports device as set forth in claim 59 wherein said signal means is a light emitting source.

61. The sports device as set forth in claim 60 wherein said signal means is a bell.

* * * * *

UNITED STATES PATENT AND TRADEMARK OFFICE

CERTIFICATE OF CORRECTION

PATENT NO. : 5,011,138

DATED : April 30, 1991

INVENTOR(S) : J. Cameron Rankin

It is certified that error appears in the above-identified patent and that said Letters Patent is hereby corrected as shown below:

Column 1, line 55, delete "10".

Column 3, line 66, delete "15".

Column 5, line 64, insert --27 -- before "and'.

Column 8, line 67, insert a dash --(-)-- after "respectively)".

Column 14, line 59, insert a dash --(-)-- after "68".

Column 16, line 68, delete "1/2" and substitute --1/4-- therefor.

Column 22, line 48, (claim 35) change "pace" to --place--.

Column 26, line 8, (claim 61) change "60" to --59--.

Signed and Sealed this

Twentieth Day of October, 1992

*Attest:*

DOUGLAS B. COMER

*Attesting Officer*

*Acting Commissioner of Patents and Trademarks*